US005187862A

United States Patent [19]

Ohsumi

[11] Patent Number: 5,187,862

[45] Date of Patent: Feb. 23, 1993

[54] DISENGAGING TOOL FOR TERMINAL AND WIRE CONNECTOR

[75] Inventor: Hideki Ohsumi, Shizuoka, Japan

[73] Assignee: Yazaki Corporation, Japan

[21] Appl. No.: 738,149

[22] Filed: Jul. 30, 1991

[30] Foreign Application Priority Data

Aug. 2, 1990 [JP] Japan ..... 2-203808

[51] Int. Cl.[5] ..... H01R 43/00

[52] U.S. Cl. ..... 29/764; 29/758; 439/595

[58] Field of Search ..... 29/764, 758, 741, 739; 439/595

[56] References Cited

U.S. PATENT DOCUMENTS 3,087,235 4/1963 Porter ..... 29/764
4,333,231 6/1982 Yeargin ..... 29/764
4,380,118 4/1983 Driver et al. ..... 29/747 X

FOREIGN PATENT DOCUMENTS 57-138285 8/1982 Japan .
59-17093 5/1984 Japan .
59-36863 10/1984 Japan .
63-112777 7/1988 Japan .

*Primary Examiner*—Carl E. Hall
*Attorney, Agent, or Firm*—Wigman & Cohen

[57] ABSTRACT

A connector has a terminal housing chamber. An elastic engaging arm for engaging the terminal extends from an inner wall. An opening with a guide groove for insertion of a disengaging tool opens to the front. The disengaging tool for disengaging a terminal from a connector is provided with a rod member for insertion into the opening. The rod member has a guide portion formed on a lateral side, extending along an axis of the stick body to guide the disengaging tool to a inner part of the connector when the rod member is inserted into the opening. A slope portion is formed on the tip of the stick body to contact the elastic engaging arm, pressing the elastic engaging arm, and bending the elastic engaging arm to disengage the elastic engaging arm from the terminal.

6 Claims, 5 Drawing Sheets

DISENGAGING TOOL FOR TERMINAL AND WIRE CONNECTOR

BACKGROUND OF THE INVENTION

1. Field of the Invention

This invention relates to a disengaging tool for disengaging a terminal from a terminal housing chamber and to a wire connector having the terminal housing chamber into which the disengaging tool is inserted.

2. Description of the Prior Art

In FIGS. 2(*a*), (*b*) and 3, a male connector 1 is provided with a connector housing 3 with a terminal housing chamber 5 extending in the front and rear directions (in the right and left direction in FIG. 2 (*a*)). A front side stopper 32 for a female terminal 9 is formed at the front side within the terminal housing chamber 5. An opening 31 for inserting a male terminal and an opening 29 for inserting a disengaging tool 13 (refer to FIG. 1) for disengaging the terminal 9 open to the front of the terminal housing chamber 5. An opening 14 for inserting the female terminal 9 opens to the rear of the terminal housing chamber 5.

An elastic engaging arm 7 is mounted on the inner side of the connector housing 3. The elastic engaging arm 7 extends to the front side of the connector housing 3 and is provided with an engaging projection 11 at the tip for engaging a engaging portion 9*a* of the female terminal 9 contained in the terminal housing chamber 5. The elastic engaging arm 7 is also provided with a tapered hook portion 15 at the tip for engaging the tip 13*a* of the disengaging tool 13.

As shown in FIG. 4, a female connector 2 is provided with a connector housing 4 with a terminal housing chamber 5 extending in the front and rear directions. A front side stopper 16 for a male terminal 17 is mounted on the front end of the terminal housing chamber 5. An opening 18 for projecting a electrical conductor portion 17*b* of the male terminal 17 and an opening 29 for inserting the disengaging tool 13 open to the front of the terminal housing chamber 5. An opening 14 for inserting the male terminal 17 opens to the rear of the terminal housing chamber 5.

An elastic engaging arm 7 is mounted on the inner wall of the terminal housing chamber 5 in the same way as the male connector 1. The elastic engaging arm 7 extends to the front side of the connector housing 4 and is provided with an engaging projection 11 at the tip for engaging a engaging hole 17*a* of the male terminal 17 contained in the terminal housing chamber 5. The tip of the elastic engaging arm 7 is also provided with a tapered hook portion 15 for engaging the tip 13*a* of the disengaging tool 13.

In the case where the female terminal 9 is inserted into the terminal housing chamber 5 of the female connector 2 and the male terminal 17 is inserted into the terminal housing chamber 5 of the male connector 1 by mistake, it is necessary that the incorrectly inserted terminals be changed.

In the case of the female terminal 9, the disengaging tool 13 with a rectangular cross-section is inserted into the opening 29, the tip 13*a* engages the hook portion 15, as shown in FIG. 3, and the disengaging tool 13 pivots on the electrical conductor portion 9*b* to bend the elastic engaging arm 7, disengaging the engaging projection 11 from the engaging portion 9*a*. Then, the female terminal 9 is extracted from the terminal housing chamber 5 to the rear.

In addition, in the case of the male terminal 17, the disengaging tool 13 is inserted into the opening 29, the disengaging tool 13 pivots on the electrical conductor portion 17*b* of the male terminal 17 in the same way as the above, disengaging the engaging projection 11 from the engaging hole 17*a*, so that the male terminal 17 is extracted from the terminal housing chamber 5 to the rear.

However, in the conventional connector and tool, because the disengaging tool 13 pivots on the electrical conductor portion 9*b*, 17*b* of the female and the male terminal 9, 17, there is concern of the electrical conductor portion 9*b*, 17*b* could be deformed.

In addition, because the engaging area of the tip 13*a* of the disengaging tool 13 and the hook portion 15 are small, there is a tendency for the engagement to be released, and there is concern that the hook portion 15 will be damaged from repeated engagement and disengagement.

Moreover, in the case of the male connector 1, there is concern that the disengaging tool 13 could be inserted into the opening 31 for the male terminal and into the electrical conductor portion 9*b* of the female terminal 9 by mistake, damaging the elastic contact portion 9*c*.

SUMMARY OF THE INVENTION

It is an object of the present invention to provide a disengaging tool for a terminal and a wire connector which can prevent the terminal from being deformed and can achieve easy disengaging of the terminal.

Another object of the invention is to provide a disengaging tool for a terminal and a wire connector which can prevent the disengaging tool from being inserted into an opening for the terminal by mistake.

According to a first aspect of the invention we provide a disengaging tool for disengaging a terminal from a connector comprising a terminal housing chamber, an elastic engaging arm for engaging the terminal, and an opening with a guide groove for insertion of the disengaging tool, said disengaging tool comprising: a rod member for insertion into the opening; a guide portion formed on a lateral side of said rod member, extending along an axis of said rod member to guide said rod member to a inner part of the connector when said rod member is inserted into the opening; and a sloped portion formed on the tip of said rod memberto contact the elastic engaging arm, pressing the elastic engaging arm and bending the elastic engaging arm to disengage the elastic engaging arm from the terminal.

According to the second aspect of the invention we provide a wire connector comprising: a housing comprising a terminal housing chamber, an opening for insertion of the other terminal and an opening with a guide groove for insertion of a disengaging tool with a guide portion, the opening for the other terminal being smaller than the opening for the disengaging tool so that the disengaging tool cannot be inserted into the opening for the other terminal, and the guide groove being formed to facilitate guiding the disengaging tool to an inner part of the housing; a terminal connected a wire, housed in the terminal housing chamber of said housing; and an elastic engaging arm extending from an inner wall of the terminal housing chamber of said housing, engaging said terminal to hold said terminal in the terminal housing chamber of said housing, for being disengaged from said terminal by the disengaging tool.

According to the present invention of the abovedescribed configuration, the disengaging tool is inserted into the the disengaging tool opening of the housing and is moved to the inner side of the housing, being guided by the guide portion and the guide groove. By this insertion operation, the sloped portion of the disengaging tool contacts the elastic engaging arm to bend the elastic engaging arm, disengaging the elastic engaging arm from the terminal, after which the terminal can be pulled out from the housing. In addition, because the width of the opening for the terminal is smaller than the width of the opening for the disengaging tool, the disengaging tool is prevented from being inserted into the opening for the terminal by mistake.

BRIEF DESCRIPTION OF THE DRAWINGS

In the accompanying drawings:

FIG. 2(*b*) is a front view showing the male connector shown in FIG. 2(*a*);

FIG. 5(*b*) is a front view showing the relative dimensions of a section at the tip of the disengaging tool shown in FIG. 5(*a*);

DETAILED DESCRIPTION OF THE PREFFERRED EMBODIMENTS

Figure 1:
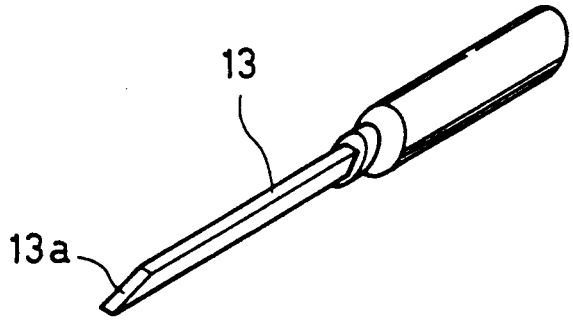
FIG. 1 PRIOR ART
FIG. 1 is a perspective view showing a conventional disengaging tool.
Figure 2A:
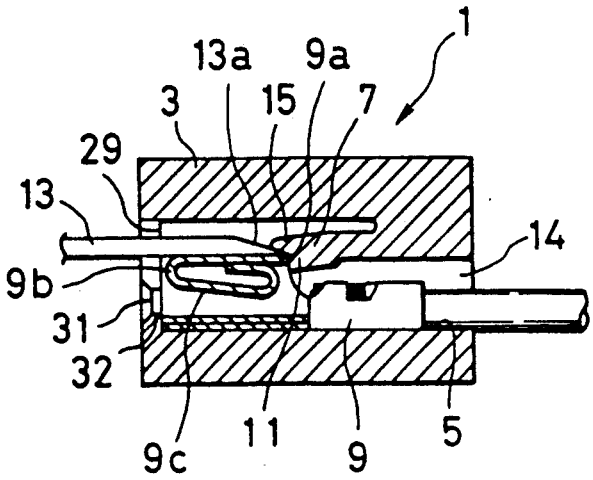
FIG. 2(a) PRIOR ART
FIG. 2(*a*) is a sectional view showing a conventional male connector.
Figure 2B:
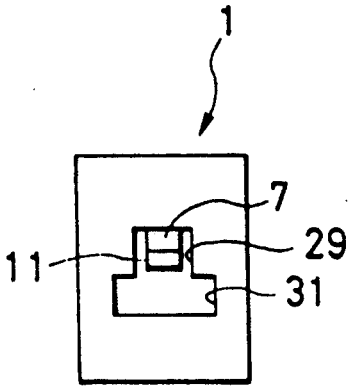
FIG. 2(b) PRIOR ART
Figure 3:
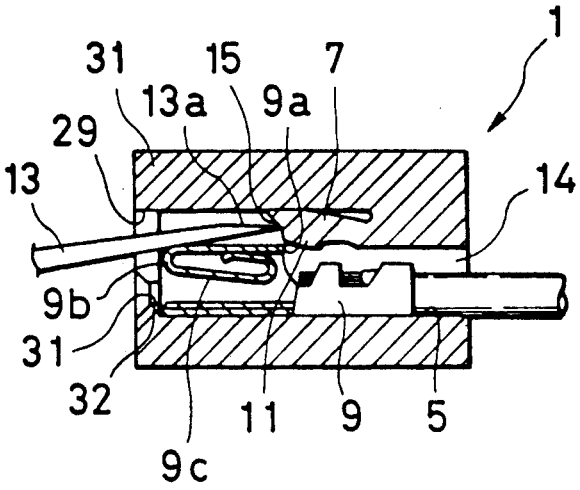
FIG. 3 PRIOR ART
FIG. 3 is a sectional view showing a operation of the disengaging tool in the male connector shown in FIG. 2(*a*)
Figure 4:
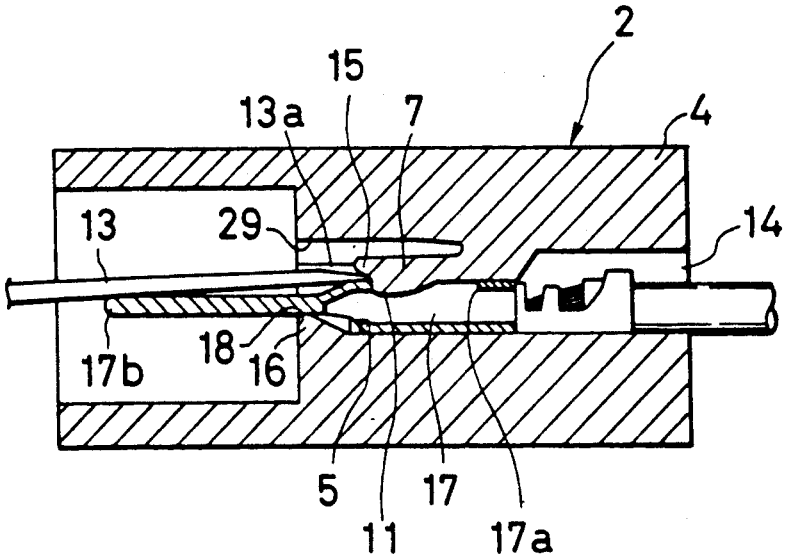
FIG. 4 PRIOR ART
FIG. 4 is a sectional view showing a conventional female connector.
Figure 5A:
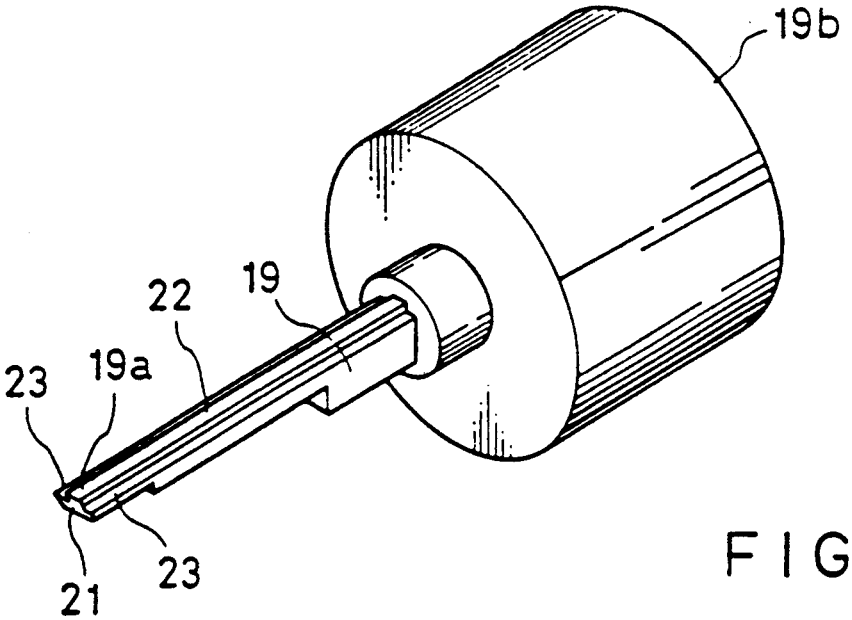
FIG. 5(*a*) is a perspective view showing a disengaging tool according to this invention.
Figure 5B:
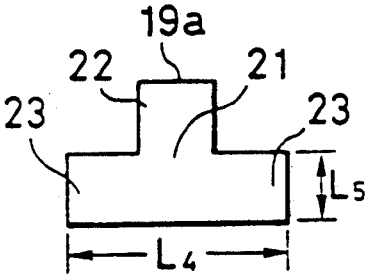

As shown in FIG. 5(*a*), a disengaging tool 19 is provided with a body 19*a* and a handle 19*b*. The body 19*a* is made of a metal rod and is provided with a slope 21 at the tip. The body 19*a* has a pair of guide 23, 23 provided integrally one at each side and a projection 22 in the central portion. As shown in FIG. 5(*b*), the guides 23, 23 project to the both side in a cross-section of the body 19*a* and the projection 22 projects to the upper side in the figure. The guides 23, 23 extend along the axis of the body 19*a*. The handle 19*b* is formed to allow easy holding.

Figure 6:
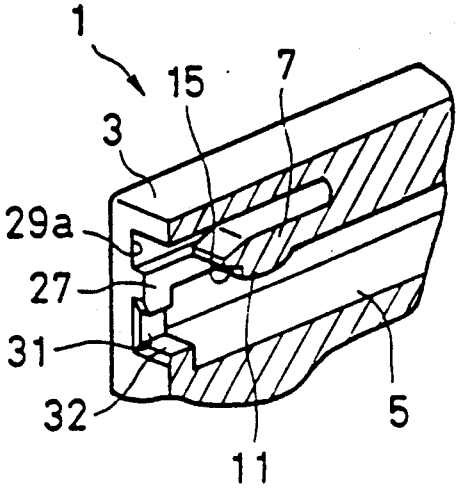
FIG. 6 is a partial sectional view showing a male connector according to this invention.
Figure 7:
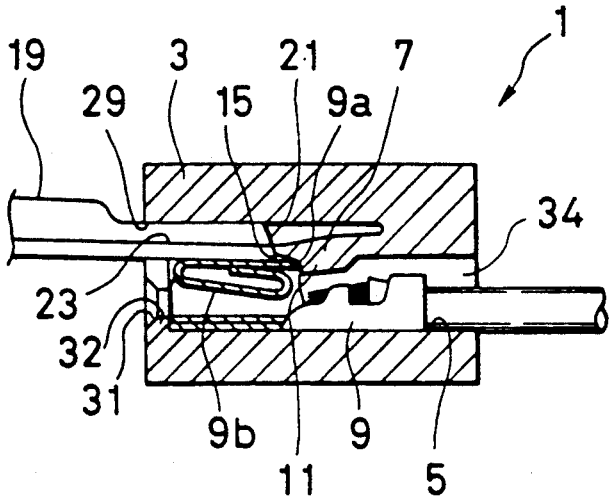
FIG. 7 is a sectional view showing the male connector shown in FIG. 6.
Figure 8:
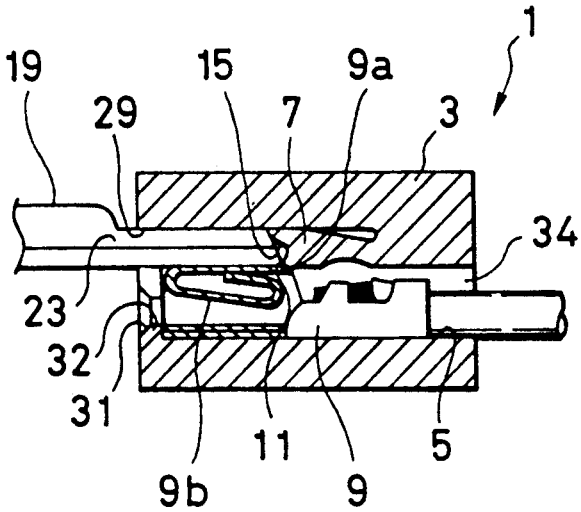
FIG. 8 is a sectional view showing the operation of the disengaging tool in the male connector shown in FIG. 7.

In FIGS. 6, 7 and 8, a male connector 1 is provided with a connector housing 3 with a terminal housing chamber 5 for a female terminal 9. The terminal housing chamber 5 extends in the front and rear direction of the connector housing 3 and a front stopper 32 for the female terminal 9 is mounted on the front side of the terminal housing chamber 5. An opening 31 for inserting a male terminal and an opening 29 with a pair of guide grooves 29*a*, 29*a* for the disengaging tool 19 open to the front of the terminal housing chamber 5, the opening 31 and 29 are interconnected through an aperture 27. The guide grooves 29*a*, 29*a* are formed so that the guides 23, 23 can be inserted into the guide grooves 29*a*, 29*a*. The aperture 27 is formed so that the projection 22 can be inserted into the aperture 27. An opening 34 for inserting the female terminal 9 opens to the rear.

An elastic engaging arm 7 extends forward from an inner side wall of the terminal housing chamber 5. The tip of the elastic engaging arm 7 is provided with an engaging projection 11 for engaging an engaging portion 9*a* of the female terminal 9 housed in the terminal housing chamber 5. The tip of the elastic engaging arm 7 is also provided with a tapered hook portion 15 for engaging the tip of the disengaging tool 19.

Next, the height of the guides 23, 23 and the guide grooves 29*a*, 29*a*, the width of the guides 23, 23 and the opening 31 and the like will be described.

The width of the guide grooves 29*a* is defined as L1, the height of the guide groove 29*a* is defined as L2, the width of the opening 31 for the male terminal is defined as L3, the width of the guides 23, 23 of the disengaging tool 19 is defined as L4, the height of the guide 23 of the disengaging tool 19 is defined as L5. Therefore the relation between the width L1 of the guide grooves 29*a*, 29*a* and the width L3 of the opening 31 can be expressed as follows.

$$L1 > L3$$

The relation between the height L2 of the guide groove 29*a* and the height L5 of the guide 23 of the disengaging tool 19 is as follows.

$$L2 \geqq L5$$

The relation among the width L1 between the guide grooves 29*a*, 29*a*, the width L4 between the guides 23, 23 of the disengaging tool 19, the width L3 of the opening 31 for the female terminal 9 is $$L1 \geqq L4 > L3$$

Therefore, the disengaging tool 19 can be inserted into the opening 29 only and cannot be inserted into the opening 31 for the male terminal of the terminal housing chamber 5.

Next, the process for extracting the female terminal 9 from the terminal housing chamber 5 will be described.

First, the tip of the body 19*a* of the disengaging tool 19 is inserted into the opening 29, the guides 23, 23 engage the guide groove 29*a*, 29*a*, and the body 19*a* of the disengaging tool 19 is moved to the inner part of the connector housing 3 (refer to FIG. 7). Then, the slope 21 at the tip of the body 19*a* contacts the hook portion 15 of the elastic engaging arm 7 to press up the hook portion 15 by sliding the hook portion 15 on the slope 21 and bending the elastic engaging arm 7 (refer to FIG. 8). As a result, the engaging projection 11 of the elastic engaging arm 7 disengage from the engaging portion 9*a* of the female terminal 9, so that the female terminal 9 can be extracted from the terminal housing chamber 5 to the rear side.

Next, another embodiment according to this invention will be described with reference to FIG. 9. This embodiment is a female connector 2 according to this invention.

Figure 9:
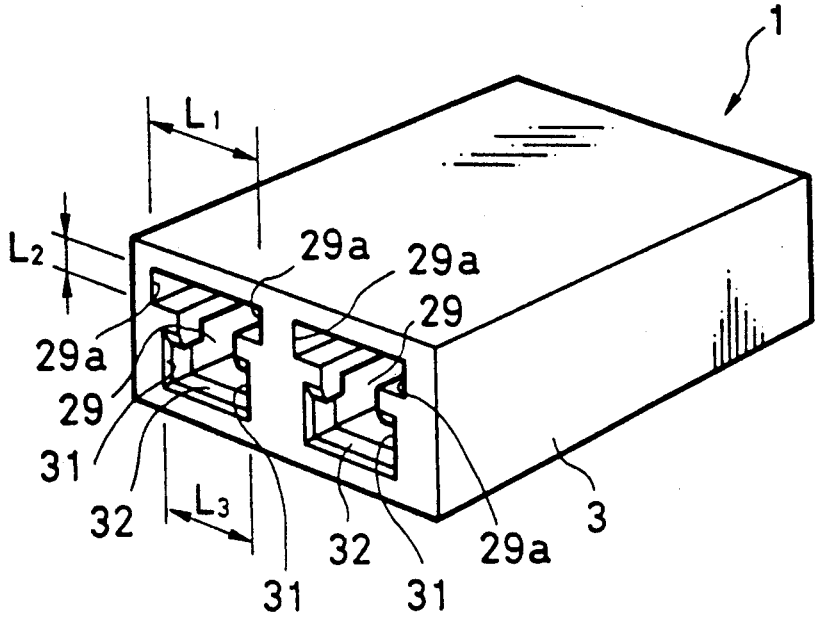
FIG. 9 is a perspective view showing the relative dimensions of the male connector shown in FIG. 7.
Figure 10:
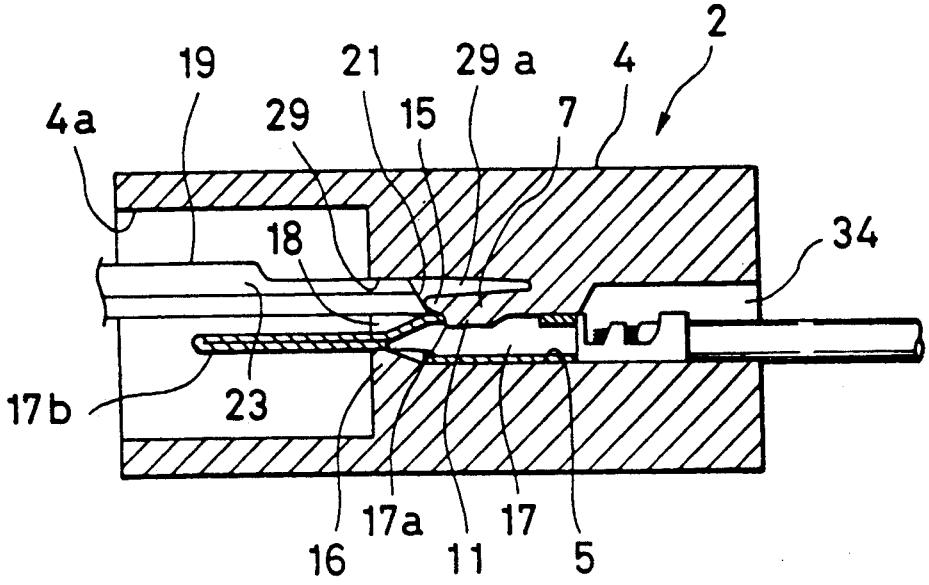
FIG. 10 is a sectional view showing a female connector according to this invention.

In FIG. 9, the same reference numerals as in FIG. 7 designate the parts corresponding to the parts in FIG. 7.

The female connector 2 is provided with a connector housing 4 having an opening 4*a* for fitting onto the male connector 3 shown in FIG. 7. The housing 4 contains a male terminal 17 of which an electrical conductor portion 17*b* projects to the opening 4*a* from the opening 18. The reference numeral 16 designates a front stopper for the male terminal 17. The opening 29 is provided with a pair of guide groove 29*a*'.

In this embodiment, the engaging projection 11 engaging the engaging hole 17*a* is disengaged by pressing the slope 21 against the hook portion 15 to bend the elastic engaging arm 7. Therefore, the male terminal 17 can be removed from the terminal housing chamber 5 to the rear.

In this case, the disengaging tool 19 can be inserted into only opening 29. The disengaging tool 19 is guided by the guide groove 29*a*', 29*a*' substantially parallel to the male terminal 17. As a result, the hook portion 15 of the elastic engaging arm is not deformed and the disengaging tool 19 can easily contact the elastic engaging arm 7.

What is claimed is:

1. A disengaging tool for disengaging a terminal from a connector comprising a terminal housing chamber, an elastic engaging arm for engaging the terminal, and an opening with a guide groove for insertion of the disengaging tool, said disengaging tool comprising:

a rod member for insertion into the opening;

a generally T-shaped guide portion formed on said rod member to be inserted into the guide groove, said guide portion extending along an axis of said rod member to guide said rod member to an inner part of the connector when said rod member is inserted into the opening; and a sloped portion formed on the tip of said rod member to contact the elastic engaging arm, bending the elastic engaging arm to disengage the elastic engaging arm from the terminal.

2. The disengaging tool according to claim 1, further comprising a handle portion connected to an end portion of said rod member.

3. A disengaging tool for disengaging a female terminal from a connector for connecting said female terminal with a male terminal, said connector comprising a terminal housing chamber for housing the female terminal, an elastic engaging arm for engaging the female terminal housed in the terminal housing chamber, an opening with a guide groove for insertion of the disengaging tool and an opening for insertion of the male terminal, said disengaging tool comprising:

a rod member for insertion into the opening;

a generally T-shaped guide portion formed on said rod member to be inserted into the guide groove, said guide portion extending along an axis of said rod member to guide the disengaging tool to an inner part of the connector when said rod member is inserted into the opening, the width of said guide portion being larger than the width of the opening for the male terminal so that said rod member cannot be inserted into the opening for the male terminal; and a sloped portion formed on a tip of said rod member to contact the elastic engaging arm, bending the elastic engaging arm to disengage the elastic engaging arm from the female terminal.

4. The disengaging tool according to claim 3, further comprising a handle portion connected to an end portion of said rod member.

5. In combination, a wire connector for connecting a female terminal with a male terminal and a disengaging tool for disengaging said female terminal from said connector, said disengaging tool having a generally T-shaped guide portion extending along the length thereof, said connector having a housing including a chamber for retaining said female terminal, a first opening in said housing for insertion of the male terminal, a second opening in said housing for insertion of said disengaging tool therein, said second opening being shaped complementary to the guide portion of said tool, said first opening being smaller than said second opening so that the disengaging tool cannot be inserted into said first opening, an elastic engaging arm extending from an inner wall of said chamber of said housing for engaging the female terminal to hold the female terminal in said housing, and wherein said engaging arm is adapted to be disengaged from the female terminal by the disengaging tool.

6. In combination, a wire connector for connecting a male terminal with a female terminal and a disengaging tool for disengaging said male terminal from said connector, said disengaging tool having a generally T-shaped guide portion extending along the length thereof, said connector having a housing including a chamber for retaining said male terminal, a first opening in said housing for insertion of said female terminal, a second opening in said housing adapted for insertion of said disengaging tool therein in a direction substantially parallel to the male terminal to prevent the disengaging tool from deforming the male terminal, said second opening being shaped complementary to the guide portion of said tool, an elastic engaging arm extending from an inner wall of said chamber of said housing for engaging the male terminal to hold the male terminal in said housing, and wherein said engaging arm is adapted to be disengaged from the male terminal by the disengaging tool.

* * * * *